US006052927A

United States Patent [19]

Pippins

[11] Patent Number: 6,052,927

[45] Date of Patent: Apr. 25, 2000

[54] SYSTEM AND METHOD FOR IMPROVING THE SERVICE LIFE OF REPLACEABLE PARTS EXPOSED TO SHOCK LOADING

[76] Inventor: Sherlock Pippins, 18352 Dallas Pkwy., Suite 136-341, Dallas, Tex. 75287

[21] Appl. No.: 09/158,339

[22] Filed: Sep. 21, 1998

[51] Int. Cl.[7] ..... E02F 9/28

[52] U.S. Cl. ..... 37/454; 37/450; 37/446

[58] Field of Search ..... 37/451, 452, 454, 37/444, 446, 455, 456, 450; 172/699, 772; 156/305

[56] References Cited

U.S. PATENT DOCUMENTS

| | | | |
|---|---|---|---|
| 5,337,495 | 8/1994 | Pippins | 37/453 |
| 5,410,826 | 5/1995 | Immel et al. | 37/457 |
| 5,435,084 | 7/1995 | Immel | 37/398 |
| 5,452,529 | 9/1995 | Neuenfeldt et al. | 37/455 |
| 5,469,648 | 11/1995 | Jones et al. | 37/457 |
| 5,638,621 | 6/1997 | Keech et al. | 37/446 |

*Primary Examiner*—Robert E. Pezzuto

*Attorney, Agent, or Firm*—Niro, Scavone, Haller & Niro

[57] ABSTRACT

A system for increasing the life of replaceable or sacrificial machine parts by providing an attachment device with controlled clearances results in substantial increases in the life of the sacrificial machine part under conditions of repeated shock loading.

2 Claims, 3 Drawing Sheets

SYSTEM AND METHOD FOR IMPROVING THE SERVICE LIFE OF REPLACEABLE PARTS EXPOSED TO SHOCK LOADING

BACKGROUND OF THE INVENTION

1. Field of the Invention

This invention relates to replaceable machine parts that are exposed to high wear and repeated shock loading, such as teeth used on dragline buckets. Specifically, the system of this invention comprises using controlled tolerances at key attachment points to provide enhanced service life.

2. Description of the Prior Art

Digging and levelling apparatus such as draglines, backhoes, front-end loaders and like often use replaceable tooth assemblies which are mounted on the tooth horns to provide sacrificial parts that are exposed to the repeated shock loading and high wear occasioned by the digging operation. In prior art systems, each tooth assembly is characterized by a wedge-shaped adapter which mounts directly on the tooth horn of the bucket, shovel or alternative digging or scraping mechanism of the equipment. A wedge-shaped tooth point is frontally seated on and rigidly pinned to the adapter for engaging the material to be excavated.

Such prior art systems are characterized by rigid attachment of the tooth or wear part to the supporting adapter, with little or no play for movement of the tooth relative to the adapter and the supporting part of the equipment. As a result, the replaceable part is repeatedly exposed to the full impact of the shock loading that occurs during the digging operation (in the case of excavating equipment) or during normal operation of the machinery, as in the case of other types of machinery.

The prior art does not suggests that the life of replaceable teeth or other sacrificial parts exposed to repeated shock loading can be extended by providing specific ranges of tolerances that permit a loose fit between the sacrificial part and its supporting assembly. Indeed, heretofore a rigid fit has been regarded as essential. U.S. Pat. No. 5,435,084 (Immel), for example, teaches that any "play" between parts leads to increased wear and should be avoided.

SUMMARY OF THE INVENTION

I have discovered that by providing a specific range of tolerances permitting some play between the sacrificial part of a machine and the support assembly to which the sacrificial part is attached, the working life of the sacrificial part can be substantially increased. The invention is particularly suited to prolonging the life of replaceable teeth used for excavating equipment such as draglines, bucket wheels, but also is applicable to other types of equipment having sacrificial parts subject to repeated shock loading.

It is an object of this invention, therefore, to provide extended life for sacrificial parts of machines, especially where such parts are subjected to repeated shock loading during operation.

It is a further object of this invention to provide an improved system for attaching replaceable teeth to drag line buckets and similar equipment.

It is still another object of this invention to provide an attachment system which offers enhanced ease of replacement of the sacrificial part, owing to the elimination of a rigid attachment to the supporting assembly.

DETAILED DESCRIPTION

I will describe the attachment system of my invention with particular reference to the attachment of replaceable teeth to excavating equipment such as dragline buckets, and more particularly to the assembly disclosed in my U.S. Pat. No. 5,337,495 (issued Aug. 16, 1994), the disclosure of which is incorporated by reference herein. Those skilled in the art will understand, however, that my invention also is applicable to other machines using replaceable parts that are subject to repeated shock loading. Examples of such machines include downhole drills and related tools, conveyor belt parts, center wear shrouds and wing shrouds on dragline buckets, track shoes for tracked vehicles, machine gun and artillery breech parts and the like.

Figures 1, 2:
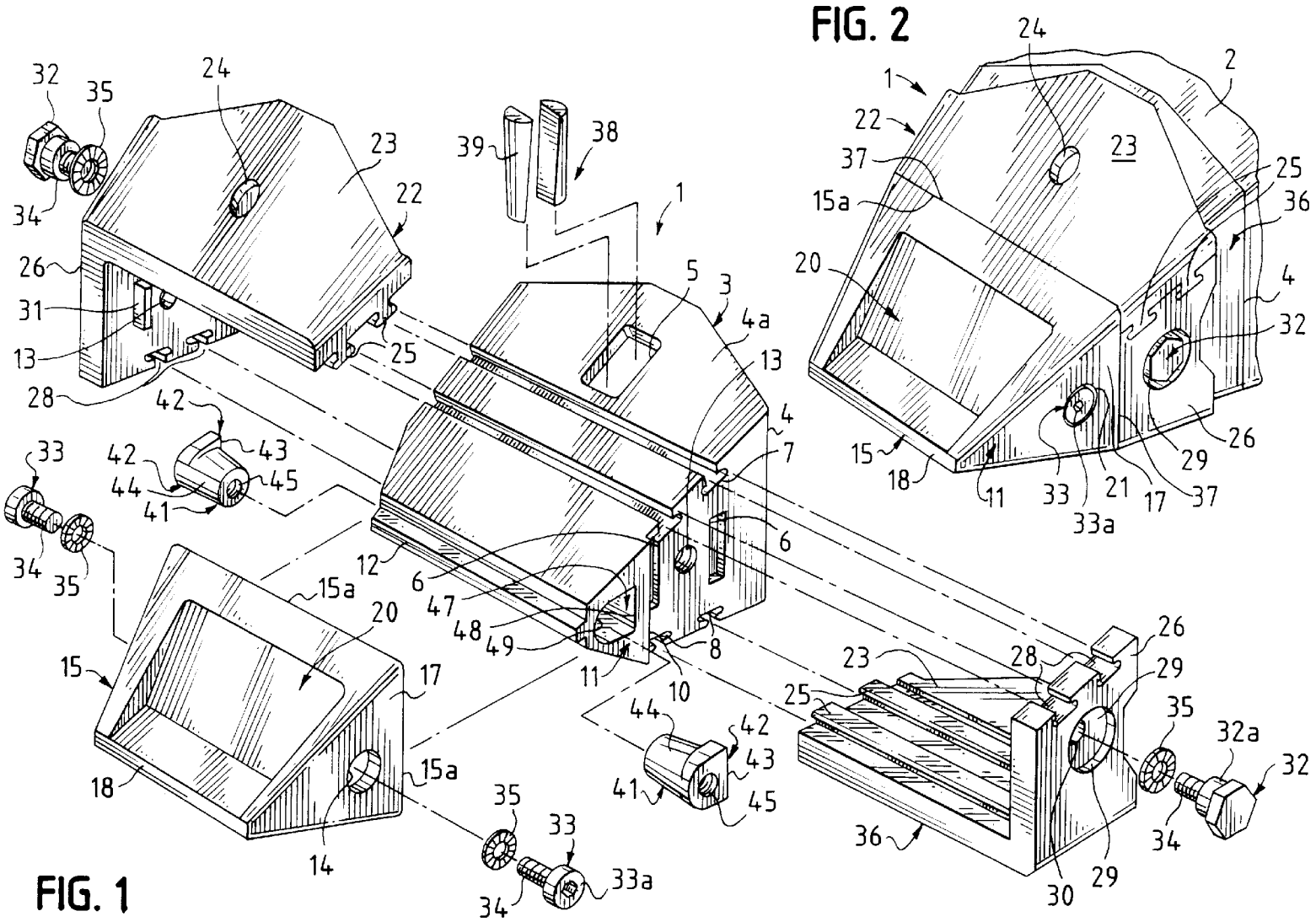
FIG. 1 is an exploded view of a preferred embodiment of the tooth assembly of this invention mounted on a conventional tooth horn of a bucket or shovel of an excavating apparatus.
FIG. 2 is a perspective view of the tooth assembly illustrated in FIG. 1 assembled on the conventional tooth horn.

Referring to the drawings and to FIGS. 1 and 2 in particular, the tooth assembly of this invention is generally illustrated by reference numeral 1 and is mounted on a conventional tooth horn 2 of the bucket or shovel of a conventional excavator (not illustrated). The tooth assembly 1 includes a wedge-shaped adapter 3, fitted with a removable tooth point 15, which has a contact edge 18 and is mounted on the adapter 3 by means of a pair of tooth point bolts 33, each extending through a tooth point bolt opening 14 in the tooth point side wall 17 of the tooth point 15 and threaded in an internally-threaded insert 41, seated in opposite sides of the adapter 3. In a preferred embodiment, the tooth assembly 1 further includes a transversely-mounted top wear cap 22 and bottom wear cap 36, both of which are also bolted to the adapter 3 by means of side plate bolts 32, respectively. In a most preferred embodiment of the invention the adapter 3 includes a wedge-shaped adapter base 4 which tapers from a base plate 4*a* to a nose ridge 12, terminating the adapter nose 11. A base plate lock opening 5 is provided in the base plate 4a of the adapter base 4 for receiving a spool 38 and a companion wedge 39 and mounting the adapter 3 on the tooth horn 2 in conventional fashion. A pair of transverse, vertically-oriented, spaced stabilizing slots 6 are provided in the sides of the adapter base 4, for purposes which will be hereinafter further described. Spaced, parallel top rib slots 7 are also provided transversely in the top tapered face of the base plate 4a of the adapter base 4 and in a most preferred embodiment, the top rib slots 7 are T-shaped, as illustrated in the drawings. Similarly, a pair of spaced, T-shaped bottom rib slots 8 are provided in the bottom tapered surface or face of the adapter base plate 4a in the same relative position as the top rib slots 7. It is understood that the top rib slots 7 and bottom rib slots 8 may alternatively be shaped in a "dove-tail", or alternative locking configuration, according to the knowledge of those skilled in the art.

Figure 3:
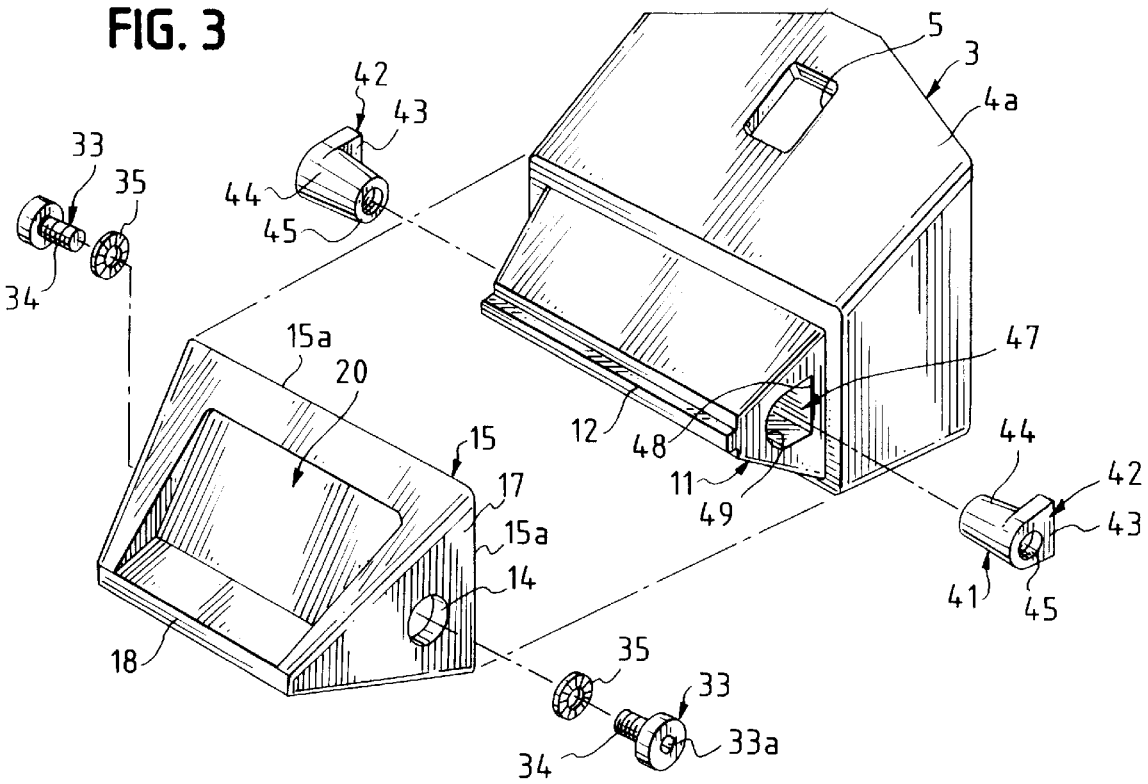
FIG. 3 is an exploded view of the adapter and tooth point elements of the tooth assembly illustrated in FIGS. 1 and 2 in a second preferred embodiment.
Figure 4:
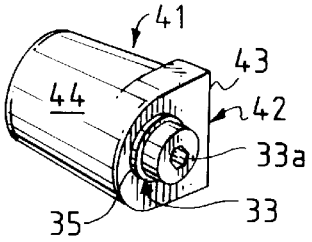
FIG. 4 is a perspective view of an insert element of the tooth assembly illustrated in FIGS. 1–3.

As further illustrated in FIG. 1, the top wear cap 22 and bottom wear cap 36 are designed to slidably mount transversely on the adapter base 4 of the adapter 3. The L-shaped top wear cap 22 and bottom wear cap 36 are each characterized by identical cap plates 23 and corresponding side plates 26 and are therefore interchangeable. The cap plate 23 of the top wear cap 22 further includes a cap plate opening 24, which registers with the base plate lock opening 5 located in the adapter 3, to provide access to the spool 38 and wedge 39 for readily tensioning the wedge 39 if necessary, as illustrated in FIG. 1. A pair of spaced, T-shaped cap plate ribs 25 are transversely located in the bottom surface of the cap plate 23 of the top wear cap 22 and are designed to register with the spaced top rib slots 7 provided in the adapter 3. Similarly, additional cap plate ribs 25 are provided in spaced relationship in the top surface of the cap plate 23 of the bottom wear cap 36 for registering with corresponding spaced parallel bottom rib slots 8, located in the bottom face of the adapter 3, also as illustrated in FIG. 1. A side plate bolt opening 30 is provided in each of the side plates 26 of the top wear cap 22 and the bottom wear cap 36 for receiving the side plate bolts 32, respectively, in order to lock the top wear cap 22 on the top and one side of the adapter 3 and the bottom wear cap 36 on the bottom and opposite side of the adapter 3, as illustrated in FIG. 2. As further illustrated in FIGS. 1 and 2 of the drawings, the adapter 3 is fitted with an adapter recess 10 on one side to facilitate recessing of the side plate 26 of the bottom wear cap 36 and extension of the corresponding cap plate ribs 25, located in the bottom surface of the cap plate 23 of the top wear cap 22, into the corresponding side plate slots 28, provided in the extending end of the side plate 26 of the bottom wear cap 36. Similarly, the projecting cap plate ribs 25, located in the cap plate 23 of the bottom wear cap 36, project in registration with the corresponding side plate slots 28, located in the extending end of the side plate 26 of the top wear cap 22 when the top wear cap 22 and bottom wear cap 36 are assembled and interlocked on the adapter 3, as illustrated in FIG. 3. A side plate recess 29 is provided in the side plate 26 of each of the top wear cap 22 and bottom wear cap 36 and surrounds a corresponding side plate bolt opening 30, to accommodate the head of the side plate bolts 32 in countersunk, recessed relationship. Furthermore, spaced side plate lugs 31 are provided in the side plate 26 of the top wear cap 22 and bottom wear cap 36 for registering with the corresponding spaced stabilizing slots 6, located in the sides of the adapter 3, respectively. Accordingly, it will be appreciated by those skilled in the art that when the top wear cap 22 and bottom wear cap 36 are mounted on the adapter 3 from opposite sides, with the respective cap plate ribs 25 engaging corresponding top rib slots 7 and bottom rib slots 8 located in the bevelled top and bottom faces of the adapter base 4*a*, respectively, the top wear cap 22 and bottom wear cap 36 are interlocked as illustrated in FIGS. 1 and 2. Furthermore, insertion of the side plate bolts 32 through the respective side plate bolt openings 30 in the side plates 26 of the top wear cap 22 and bottom wear cap 36, respectively, and threading of the side plate bolts 32 in the respective threaded openings 13 located in the sides of the adapter 3, locks the top wear cap 22 and bottom wear cap 36 securely on the adapter 3, with the side plate lugs 31 engaging the corresponding stabilizing slots 6 located in the adapter 3. The top wear cap 22 and bottom wear cap 36 are thus prevented from disengaging the adapter 3 without removing the side plate bolts 32. Moreover, the heads of the side plate bolts 32 are securely recessed inside the respective side plate recesses 29, provided in the side plates 26, to minimize the possibility of shearing the side plates bolts 32 from the tooth assembly 1.

In another preferred embodiment of the invention each of the side plate bolts 32 is provided with a bolt shoulder 32*a* located beneath the head thereof and includes bolt threads 34. A lock washer 35, illustrated in FIG. 1, may be provided on the threaded shank of the side plate bolts 32 for securing each of the side plate bolts 32 in the adapter 3, as illustrated in FIG. 2. However, in a most preferred embodiment of the invention the heads of the respective side plate bolts 32 are spaced from the recess shoulder 29*a* of each side plate recess 29. This spacing facilitates limited movement of the top wear cap 22 and bottom wear cap 36 with respect to the adapter 3 as described in my U.S. Pat. No. 5,172,501 and serves as a stress-relieving function to minimize damage to the tooth assembly 1 by operation of the excavation or levelling equipment upon which the tooth assembly 1 is mounted.

Referring now to FIGS. 1 and 3–5 of the drawings, the tooth point 15 is removably attached to the adapter 3 by means of two tapered inserts 41, each inserted in a correspondingly-shaped insert cavity 47, provided in the wedge-shaped tooth point side walls 17 of the adapter 3. Each insert 41 includes an internally-threaded insert bore 45, extending through a tapered, rounded insert body 44 which terminates in an insert shoulder 42, having a straight shoulder edge 43. The respective oppositely-disposed insert cavities 47 are tapered and shaped to define a cavity shoulder 48, which engages the insert shoulder 42, and a body curvature 49, which engages the insert body 44. Accordingly, the insert cavities 47 removably receive the inserts 41 and prevent the inserts 41 from rotating when pressure is applied to the tooth point bolts 33, which secure the tooth point 15 on the adapter 3. This pressure is applied by means of an allen wrench (not illustrated) inserted in the alien wrench receptacle 33*a* provided in the head of the tooth point bolt 33. Those skilled in the art will understand that various shapes can be used for insert 41, such as square, star-shaped and the like, so long as insert 41 is shaped so that rotation is prevented when it is inserted into insert cavity 47.

Figure 5:
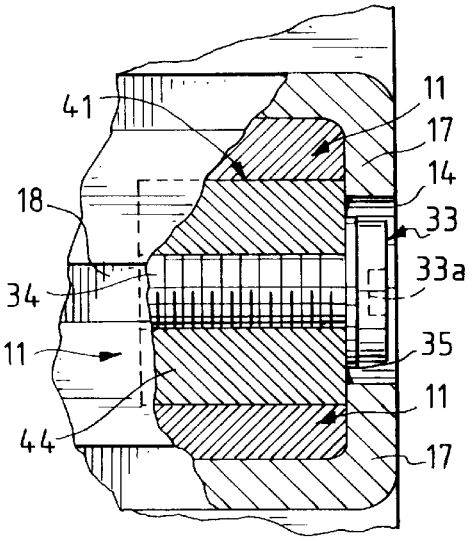
FIG. 5 is a partial sectional view of the adapter, tooth point and insert elements of the tooth assembly in assembled configuration as illustrated in FIG. 2.

Accordingly, referring again to FIGS. 1 and 2, the tooth point 15 is designed to mount frontally on the adapter nose 11 of the adapter 3 by matching the tooth point bolt openings 14, located in the opposite tooth point side walls 17 of the tooth point 15, with the corresponding insert bores 45, provided in the inserts 41. Each tooth point bolt 33 is then registered with a corresponding tooth point bolt opening 14 and the threaded shank of each tooth point bolt 33 is inserted into the corresponding internally-threaded insert bore 45 located in the insert 41, to removably secure the tooth point 15 on the adapter 3. When the tooth point 15 is so inserted on the adapter 3, the tooth point edge 15*a* is located in close proximity to the corresponding edges of the cap plates 23 and side plates 26 of the top wear cap 22 and bottom wear cap 36, respectively, as illustrated in FIG. 2. However, a working gap 37 is maintained between the tooth point edge 15*a* of the tooth point 15 and the front edges of the top wear cap 22 and bottom wear cap 36, respectively, to facilitate movement of the tooth point 15 and top wear cap 22, as well as the bottom wear cap 36, with respect to the adapter 3. In a most preferred embodiment of the invention, like the top wear cap 22 and the bottom wear cap 36, the tooth point 15 is secured to the adapter 3 using a tooth point bolt 33 which is fitted with a lock washer 35. As illustrated in FIG. 5, since the diameter of the tooth point bolt opening 14 is smaller than the external dimensions of the inserts 41 at the insert shoulder 42, the inserts 41 cannot exit the respective insert cavities 47 through the tooth point bolt openings 14. However, the inserts 41 can be easily removed from the insert cavities 47 when the teeth are removed from the adapter 3. Accordingly, the adapter nose 11 is afforded a range of movement on the adapter 3 due to the space between the heads of the tooth point bolts 33 and the periphery of the tooth point bolt openings 14, as well as the working gap 37, to relieve digging stresses.

It will be appreciated from a consideration of the drawings that the tooth assembly of this invention exhibits multiple favorable structural characteristics not found in conventional assemblies. The interlocking relationship between the top wear cap 22 and bottom wear cap 36, along with the transverse, slidable mounting of these structural members and the removable mounting of the tooth point 15 on the adapter 3, facilitate an extremely strong, versatile wear-resistant assembly. Furthermore, recessing of the respective side plate bolts 32 and tooth point bolts 33, as well as the side plates 26 of the top wear cap 22 and the bottom wear cap 36 provided in opposite sides of the adapter 3, facilitate excavation and levelling of all types of material without fear of shearing the respective side plate bolts 32 and tooth point bolts 33. Moreover, use and replacement of the top wear cap 22, bottom wear cap 36 and tooth point 15 independently or in concert, is quickly and easily facilitated in an optimum manner by simply removing the side plate bolts 32 and tooth point bolts 33, sliding the top wear cap 22, bottom wear cap 36 and tooth point 15 from the adapter 3 and replacing these members by reversing this procedure. Shock and impact resistance of the tooth assembly 1 is facilitated by mounting the top wear cap 22 and bottom wear cap 36 and tooth point 15 in a non-rigid, but secure relationship on the adapter 3 to facilitate a selected minimum movement of the top wear cap 22, bottom wear cap 36 and tooth point 15 with respect to the adapter 3 during operation. Use of the inserts 41 to mount the tooth point 15 on the adapter 3 facilitates quick and easy removal and replacement of the tooth point 15 without risk of cross-threading the tooth point bolts 33 directly into tapped holes provided in the adapter 3. Such tapped holes are subject to various types of damage and the inserts 41 are capable of easy replacement to avoid this problem. A tooth assembly 1 is mounted on each tooth horn 2 of a conventional bucket or shovel of a conventional excavating apparatus in conventional manner, utilizing the spool 38 and wedge 39, according to the knowledge of those skilled in the art. It will be appreciated that alternative means for mounting the tooth assembly 1 to the tooth horn of such equipment may also be implemented without departing from the spirit and scope of the invention as embodied herein.

Figure 6:
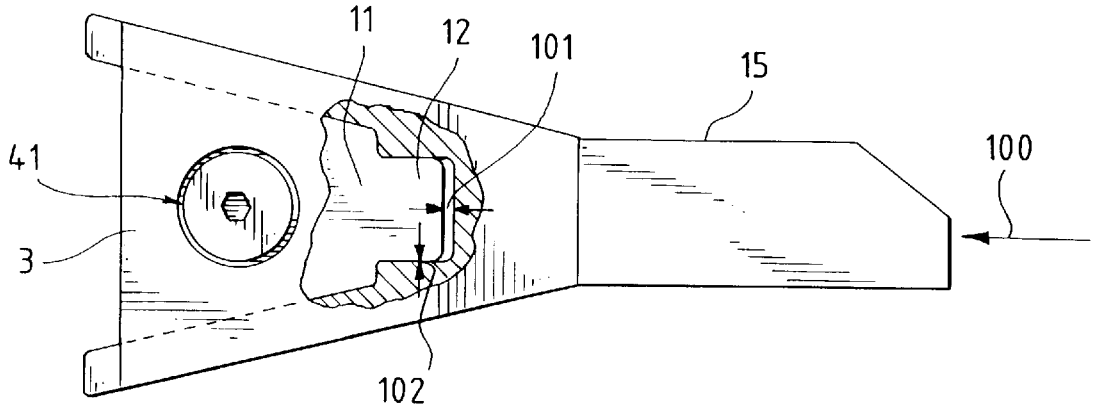
FIG. 6 is a side view of the tooth assembly showing the locations where specific tolerances are provided according to my invention.
Figure 7:
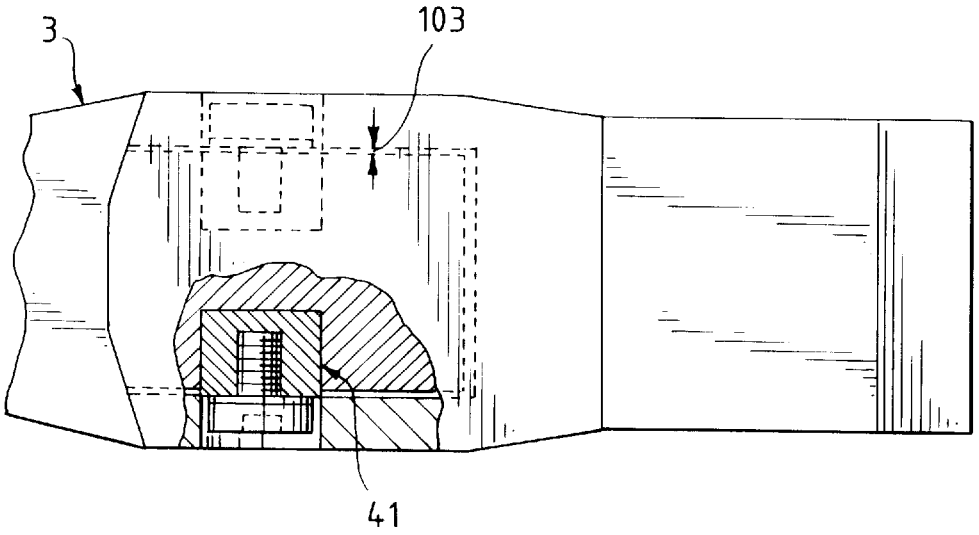
FIG. 7 is a top view of the tooth assembly also showing the locations where specific tolerances are provided according to my invention.

FIG. 6 and FIG. 7 illustrate the specific tolerances of my invention. FIG. 6 shows a preferred embodiment of my invention as applied to a replaceable tooth point 15 for a dragline bucket. In the side view of FIG. 6, the removable tooth point 15 is shown attached to the wedge-shaped adapter 3, held loosely in place by insert 41. The approximate direction of the heaviest shock load is shown at reference numeral 100. As shown in the following examples, I have found that providing the following clearances between the sacrificial part (the removable tooth point 15, in this example) and the adapter 3 upon which it is mounted will effectively and surprisingly increase the life of the sacrificial part:

Horizontal clearance at reference numeral 101 in approximate direction of shock: about 1/8 inch to about 1/4 inch.

Vertical clearance at reference numeral 102 normal to approximate direction of shock: about 1/32 inch to about 3/16 inch; preferably about 1/16 inch to about 1/8 inch.

Horizontal clearance at reference numeral 103 normal to approximate direction of shock: about 1/32 inch to about 1/16 inch.

I find that if larger clearances are used the teeth will tend to move forward and contact the bolts, causing failure by bending or fracture; whereas if smaller clearances are used there will be interference from the castings, notably between the adapter 3 and the sacrificial part 15.

EXAMPLES

In a test comparing dragline bucket teeth attached to a 90 cubic yard dragline bucket according to my invention with conventional, rigidly-attached dragline bucket teeth, the teeth attached according to my invention exhibited an average life of approximately 161 hours compared to 79 hours for the conventionally-attached teeth. The adapter used with the non-rigid attachment system of my invention exhibited an average life of approximately 1655 hours compared to 1113 hours for the adapter using conventional, rigid attachment to the teeth.

In another test at a Phelps-Dodge mine, the rate of tooth wear using my non-rigid attachment system on a dragline bucket was approximately 0.75 inches per 24 hour period, approximately half the rate of wear for conventional, rigid attachment of the teeth.

Those skilled in the art will appreciate that increasing the life of the sacrificial parts not only saves money for replacement parts themselves, but also reduces maintenance downtime and labor costs for parts replacement.

I claim:

1. A non-rigid attachment system for a sacrificial machine part that is subjected to shock loading, comprising:

a. a replaceable sacrificial machine part;

b. an adapter for attaching said sacrificial machine part to a machine body, providing clearance between said adapter and said sacrificial machine part in a direction approximately parallel to said shock loading and in a direction approximately normal to said shock loading;

wherein said clearance approximately parallel to said shock loading is between about 1/8 inch and about 1/4 inch; and said clearance normal to said shock loading is between about 1/32 inch and about 3/16 inch.

2. A tooth assembly for mounting on a digging implement in an excavating apparatus, comprising:

a tooth horn mounted on said digging implement;

a wedge-shaped adapter having top and bottom faces and adapted for mounting on the tooth horn;

at least one insert cavity provided in a side of said adapter, an insert body;

said insert cavity being shaped to engage said insert body, each of said insert cavity and said insert body being shaped to prevent rotation when said insert body engages said insert cavity, an internally-threaded insert aperture in said insert body;

a tooth point shaped for removably mounting on said adapter and at least one bolt opening provided in a side of said tooth point; and a tooth point bolt for extension through said bolt opening and threadably engaging said insert aperture, bolting said tooth point to said adapter, wherein the horizontal clearance between said tooth point and said adapter is between about 1/8 inch and about 1/4 inch and the vertical clearance between said tooth point and said tooth point adapter is between about 1/32 inch and about 3/16 inch, whereby said tooth point is removable from said adapter after removal of said tooth point bolts.

* * * * *